US009909842B2

(12) United States Patent
Moran et al.

(10) Patent No.: US 9,909,842 B2
(45) Date of Patent: Mar. 6, 2018

(54) ARMOUR

(71) Applicant: NP Aerospace Limited, Coventry (GB)

(72) Inventors: Anthony Moran, Conventry (GB); Christopher Davies, Kenilworth (GB)

(73) Assignee: NP Aerospace Limited, Coventry (GB)

( * ) Notice: Subject to any disclaimer, the term of this patent is extended or adjusted under 35 U.S.C. 154(b) by 0 days.

(21) Appl. No.: 14/416,237

(22) PCT Filed: Jul. 19, 2013

(86) PCT No.: PCT/GB2013/000314
§ 371 (c)(1),
(2) Date: Jan. 21, 2015

(87) PCT Pub. No.: WO2014/016541
PCT Pub. Date: Jan. 30, 2014

(65) Prior Publication Data

US 2015/0176950 A1 Jun. 25, 2015

(30) Foreign Application Priority Data

Jul. 27, 2012 (GB) ..... 1213560.4

(51) Int. Cl.
*F41H 5/04* (2006.01)

(52) U.S. Cl.
CPC ..... *F41H 5/0414* (2013.01); *F41H 5/0492* (2013.01)

(58) Field of Classification Search
CPC ..... F41H 5/02–5/0492
USPC ..... 89/917
See application file for complete search history.

(56) References Cited

U.S. PATENT DOCUMENTS 3,431,818 A * 3/1969 King ..... F41H 5/0414 109/80
3,616,115 A * 10/1971 Klimmek ..... F41H 5/0414 109/84
4,307,140 A * 12/1981 Davis ..... B29C 37/0082 156/276
4,757,742 A * 7/1988 Mazelsky ..... F41H 5/023 109/79
4,774,143 A * 9/1988 Gondela ..... B32B 17/10055 428/428
4,911,061 A 3/1990 Pivitt et al.
(Continued)

FOREIGN PATENT DOCUMENTS

EP 0611943 A1 8/1994
EP 1959223 A2 8/2008
(Continued)

OTHER PUBLICATIONS

International Patent Application No. PCT/GB2013/000314, International Search Report and Written Opinion dated Oct. 17, 2013.
(Continued)

*Primary Examiner* — Stephen Johnson
*Assistant Examiner* — Joshua T Semick
(74) *Attorney, Agent, or Firm* — Kilpatrick Townsend & Stockton LLP; Dean W. Russell

(57) ABSTRACT

Armor comprises an array of tiles or pellets confined between at least a pair of sheets, and in which at least one of said at least a pair of sheets is weakened overlying boundaries between adjacent tiles or pellets.

19 Claims, 4 Drawing Sheets

(56) References Cited

U.S. PATENT DOCUMENTS 5,333,532 A * 8/1994 Smirlock ..... F41H 5/013 109/49.5
5,771,489 A * 6/1998 Snedeker ..... F41H 5/0492 2/2.5
5,915,528 A * 6/1999 Shmuelov ..... F41H 5/0492 2/2.5
5,972,819 A 10/1999 Cohen
6,532,857 B1 * 3/2003 Shih ..... F41H 5/0421 89/36.02
6,826,996 B2 12/2004 Strait
7,093,301 B1 * 8/2006 Moore, Jr. ..... A41D 13/0518 2/2.5
7,584,689 B2 * 9/2009 Jones ..... B32B 17/10009 89/36.02
7,698,984 B2 * 4/2010 LaBrash ..... F41H 5/023 89/36.02
7,752,955 B2 * 7/2010 Engelbart ..... F41H 5/0428 89/36.02
7,997,181 B1 * 8/2011 Tunis ..... F41H 5/0435 89/36.02
8,096,224 B2 * 1/2012 Martin ..... F41H 5/0414 89/36.02
8,424,442 B2 * 4/2013 Ward ..... F41H 5/0414 52/385
8,673,103 B2 * 3/2014 Gendlin ..... B29C 43/18 156/247
8,720,314 B2 * 5/2014 Engelbart ..... F41H 5/0435 296/187.07
8,978,536 B2 * 3/2015 Dodworth ..... F41H 5/023 296/187.07
2007/0125223 A1 * 6/2007 Heidenreich ..... F41H 5/0414 89/36.02
2009/0114083 A1 5/2009 Moore, III et al.
2010/0104819 A1 * 4/2010 Wadley ..... B29C 70/24 428/182
2012/0137864 A1 6/2012 Ortiz et al.

FOREIGN PATENT DOCUMENTS

EP 1734332 B1 3/2012
FR 1288455 A 3/1962
GB 116685 11/1918
WO 2006103431 10/2006

OTHER PUBLICATIONS

GB Patent Application 1213560.4, Search and Examination Reported dated Nov. 19, 2012, 5 pages.
EP Application 13744766.0, Summons to attend oral proceedings pursuant to Rule 115(1) EPC dated Feb. 2, 2016, 5 pages.

* cited by examiner

ARMOUR

CROSS-REFERENCE TO RELATED APPLICATIONS

This application is the U.S. national phase entry of International Patent Application No. PCT/GB2013/000314, entitled "ARMOUR," filed Jul. 19, 2013, which application claims the benefit of United Kingdom Patent Application No. 1213560.4, entitled "ARMOUR," filed Jul. 27, 2012, the entire disclosures of both of which are hereby incorporated herein by reference.

This invention relates to ballistic armour for vehicles and installations.

Ceramic materials have been used in armour from at least the 1950's. However, a major disadvantage of ceramic materials is that they tend to be brittle, limiting their ability to withstand multiple hits. A first bullet impact can crack the ceramic, resulting in a loss of protection against a second impact.

To overcome this problem, armour is known in which a plurality of ceramic tiles or pellets, frequently hexagonal although possibly of other shapes, are assembled together in a spaced relationship with resilient material therebetween, and confined between a pair of sheets that provide environmental protection and structural rigidity to the assembly [see for example U.S. Pat. No. 6,826,996, EP1734332 and WO2006/103431].

Such armour has the advantage that damage to a single tile or pellet does not necessarily result in cracks propagating through adjacent tiles. However, under extreme impact, the resilience of the material between the tiles is insufficient to absorb the energy of impact and cracks propagate through several tiles. This limits the ability of the armour to accept multiple hits.

The applicants have found that this problem can be mitigated by providing the armour as an array of tiles or pellets confined between a pair of sheets, in which at least one of said sheets is weakened overlying some boundaries between adjacent tiles or pellets.

At least one of the tiles or pellets may be an individually confined tile or pellet, which may be confined between a further pair of sheets.

The tiles or pellets may comprise bonded groups of tiles or pellets, said groups being assembled in an array and confined between at least a pair of sheets.

The bonded groups of tiles or pellets may comprise an array of tiles or pellets confined between a further pair of sheets.

The armour may comprise an array of tiles or pellets confined between a pair of sheets, in which at least one of said sheets is weakened overlying some boundaries between adjacent tiles or pellets to define bonded groups of tiles or pellets between said boundaries.

Further features of the invention are set out in the claims and are illustrated by way of example in the following description and with reference to the drawings in which:

Figure 1:
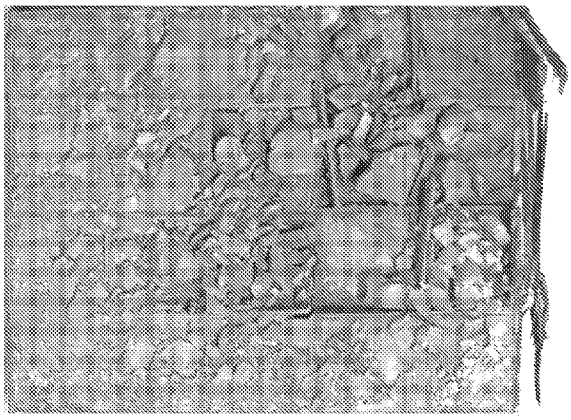
FIG. 1 is a photograph of a comparative tiled armour after impact from a medium calibre weapon.

In the drawings, FIG. 1 is a photograph of a comparative tiled armour after impact from a 30 mm APDS Rarden round fired from a medium calibre cannon. Such armour can resist heavy machine gun rounds but, as can be seen, after impact from medium calibre rounds there is ceramic trauma and extended failure across the strike face. This appears to result from lateral transmission of shock from one tile to the next.

Figure 2:
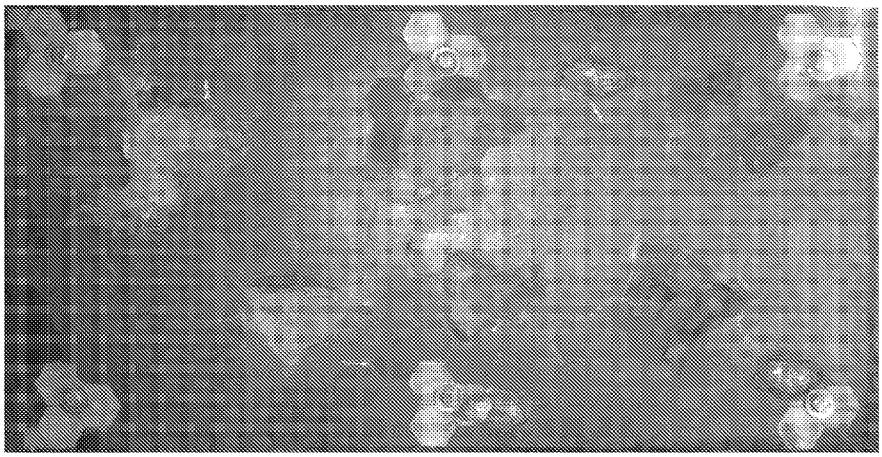
FIG. 2 is a photograph of the front face of tiled armour in accordance with the invention after receiving multiple strikes from a medium calibre weapon.
Figure 3:
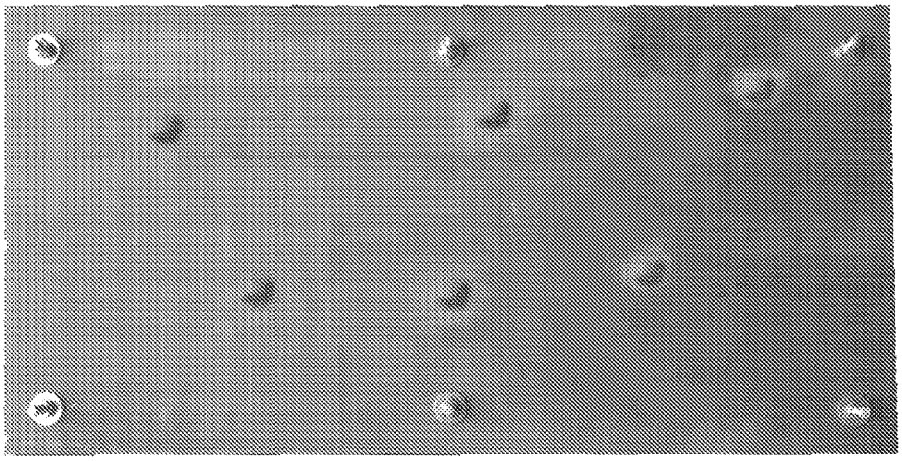
FIG. 3 is a photograph of the rear face of tiled armour in accordance with the invention after receiving 6 strikes from a medium calibre weapon and 6 strikes from heavy machine gun rounds.

FIGS. 2 and 3 show armour according to the present invention after receiving multiple hits from 30 mm APDS Rarden rounds fired from a medium calibre cannon. As can be seen, the armour defeated the projectiles with minimal bulging of the back plate [described below].

Figure 4:
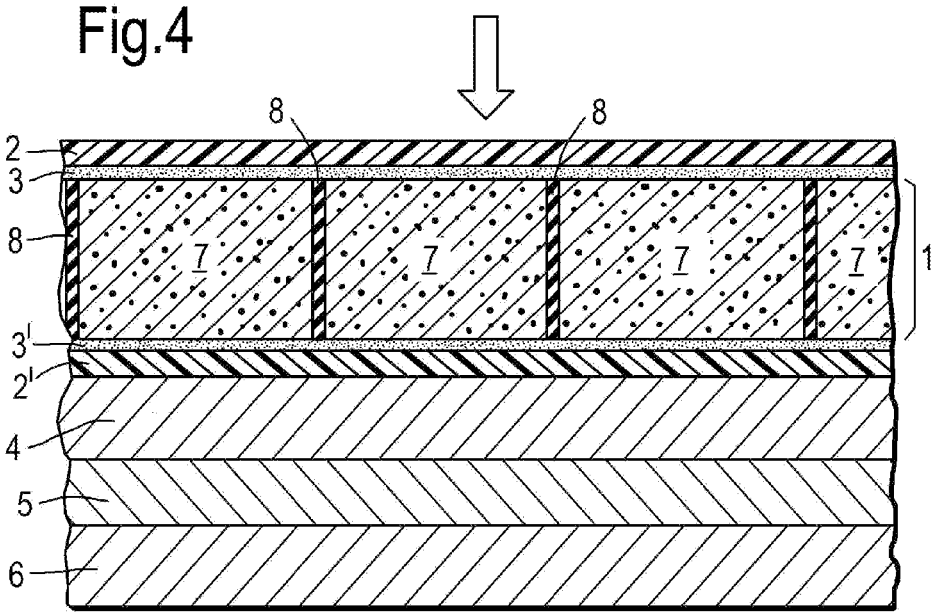
FIG. 4 is an overall schematic of the armour of FIGS. 2 and 3.

FIG. 4 is an overall schematic of the armour of FIGS. 2 and 3 which comprises a layer 1 of bonded groups 7 of tiles or pellets assembled in spaced relationship in an array [as described in more detail below] with resilient material 8 [e.g. rubber] therebetween.

The layer 1 is confined between sheets 2, 2' [which may be of polycarbonate] bonded to the layer 1 by adhesive layers 3, 3' [which may be polyurethane adhesive]. The front of the armour that would receive an impact in use is indicated by the arrow. Behind the layer 1 and confining sheets 2 is a ballistic backing 4.

Ballistic backings are typically composites and typically include one or more of carbon fibres, glass fibres, aramid fibres, high density polyethylene fibres, polyoxazole fibres, metal fibres, or metal plates. However, this list is not exhaustive and other backings may be used. Trade names for commercially available ballistic backings include SpectraShield™ and GoldShield™ [Honeywell] and Dyneema™ [DSM]. The backing used in the examples is Carbon Fibre Epoxy—MTM57-FRB/PANEX35.

At the back of the armour there is a metal plate 6. The assembly of layer 1 and ballistic backing 4 is secured to the metal plate using bolts [apparent in FIGS. 2 and 3].

Behind the ballistic backing 4 is an air gap, although foam material may be used in its stead or the air gap could be removed placing the appliqué armour in contact with the metal plate It should be noted that although in the examples a steel plate was used, other metals may be usable and the metal plate may be omitted with the armour applied directly to a vehicle or structure to be armoured.

Figure 5:
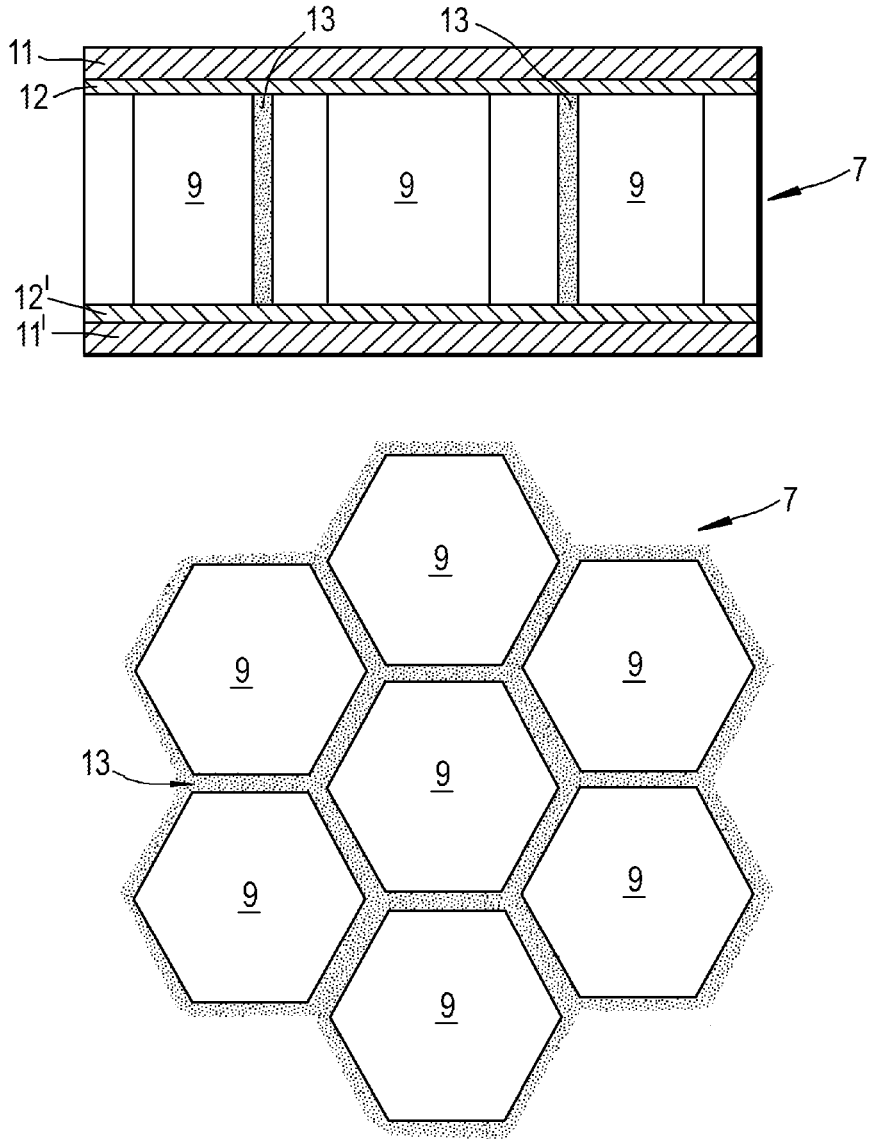
FIG. 5 shows schematically in section and in plan a bonded group for use in the armour of FIGS. 2 and 3.

FIG. 5 shows details of the bonded groups 7, which comprise ceramic tiles 9 in spaced relationship with resilient material 13 [e.g. rubber] therebetween. A group of seven hexagonal tiles is shown. Other tile shapes and group numbers may be used as appropriate. A group of three hexagonal tiles in mutual contact is useful. In the example shown in FIGS. 2 and 3, the tiles are hexagonal tiles of sintered silicon carbide with an edge to edge distance of 50 mm and thickness of 20 mm but other dimensions are applicable according to the level of threat to be received.

The ceramic tiles 9 are confined between sheets 11, 11' [which may be of polycarbonate] bonded to the tiles 9 by adhesive layers 12, 12' [which may be polyurethane adhesive].

The invention is not limited to polycarbonate sheets and other materials [e.g. polyethylene terephthalate polyester film or impregnated textile materials] may be used for the sheet.

Adhesives that may be used include epoxy, cyanoacrylate, polysulphide, and polyurethane adhesives. However, this list is not exhaustive and other adhesives sufficient to provide good adherence to the ceramic may be used.

Figure 6:
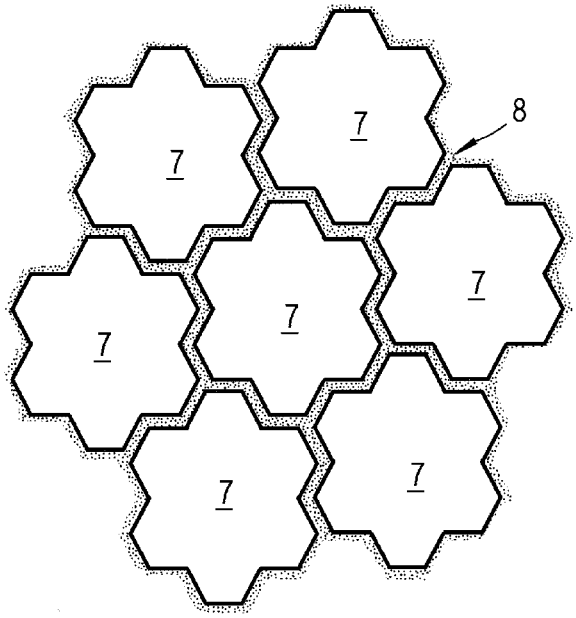
FIG. 6 shows tessellation of bonded groups to form armour according to the invention.

The groups 7 tessellate as shown in FIG. 6. Individual tiles or smaller groups of tiles [e.g. groups of three] may be provided at the edge of the armour plate to provide more complete coverage.

As will be evident, in the finished armour, the ceramic tiles 9 of each group 7 will be confined by four sheets [counting from the front of the armour, sheets 2; 11; 11'; and 2'].

In contrast, above the resilient material 8 disposed between the bonded groups 7, there will be only two sheets [2,2']. This provides a region of weakness between the groups.

Surprisingly it has been found that the effect of this arrangement is that under ballistic impact the bonded groups 7 appear to move relative to the rest of the layer 1, in some cases popping out under the impact, but mitigating the transmission of shock to the rest of the armour. This reduces the risk of failure under multiple hits.

It is apparent that there are many variants that could achieve the same effect. For example, an equivalent regions of weakness may be provided by an array of tiles or pellets confined between a pair of sheets, in which at least one of said sheets is weakened overlying some boundaries between adjacent tiles or pellets to define bonded groups of tiles or pellets between said boundaries.

Another variant is where at least one of the bonded groups of tiles or pellets comprises individually confined tiles or pellets. For example, the armour may contain 3 pairs of sheets, each being separated and weakened to different levels. The layer in contact with the ceramic encapsulating one tile only, the next defining a bonded group and the third encapsulating the entire assembly.

Figure 7:
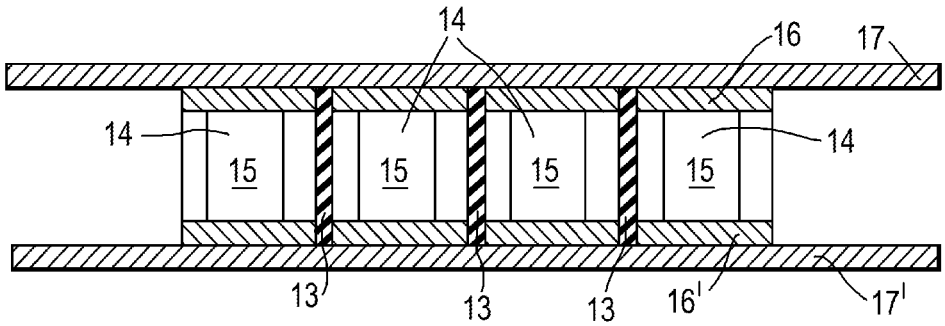
FIG. 7 shows an individually confined tile or pellet for use in the invention.

A further variant (shown in FIG. 7) was tested in which the tiles or pellets were not supplied as bonded groups, but as individually confined tiles or pellets 14, each comprising a hexagonal tile or pellet 15 confined between a pair of polycarbonate sheets 16,16' bonded to the tile or pellet using a polyurethane adhesive and disposed in an array in spaced relationship with resilient material 13 [e.g. rubber] therebetween; and bonded between a pair of polycarbonate sheets 17,17' using a polyurethane adhesive. The sheets 17,16 and 17',16' constituted weakened sheets with the weakening being the gaps between the sheets 16 (and 16') of adjacent confined tiles or pellets 14. Thus both sheets 17,16 and 17',16' were weakened overlying the boundaries between adjacent tiles or pellets. This construction showed a similar effect to that shown by the bonded groups, in that the weakening permitted individual tiles to move under impact, so mitigating the transmission of shock to the rest of the armour.

A comparative arrangement of identical structure to the above variant, but in which the polycarbonate sheets 16,16' were each replaced by continuous polycarbonate sheets was also tested. The applicants reserve the right to claim such an arrangement in this or a divisional application, and to claim details of material or construction as disclosed and claimed for the other arrangements described herein. This arrangement can be considered as providing armour comprising an array of tiles or pellets confined between at least an upper pair of sheets and a lower pair of sheets. Further layers of sheets may be applied, in this (or indeed any of the other) arrangements.

Both these variants and that of FIGS. 2 to 6 were able to defeat the medium calibre cannon threat mentioned above. Testing has not yet demonstrated whether there is any difference under higher threats, but the applicants believe that at higher threat levels the comparative arrangement comprising upper and lower pairs of continuous sheet will transmit shock further than the arrangement comprising weakening at boundaries between tiles or pellets or bonded groups of tiles or pellets. This has been observed to some extent in that the armour of FIGS. 2 to 6 showed clear signs that the bonded groups had limited the area of damage [see FIG. 2].

The number of layers of sheets need not be symmetrical about the tiles or pellets, and more layers may be provided at front or at back than are provided at back or front respectively.

The present invention is not limited to particular materials or groups of materials but is defined by the geometry of assembling tiles or pellets, or bonded groups of tiles or pellets, between at least one pair of sheets where at least one of said a pair of sheets is weakened overlying some boundaries between adjacent tiles or pellets. The rear sheet need not necessarily be of the same material as the front sheet and indeed could form part of the backing to the armour.

Although the weakening has been exemplified above by provision of several layers forming the at least one pair of sheets, with one layer comprising separate sheets each overlying individual tiles or pellets, or bonded groups of tiles or pellets, it is apparent that a similar effect may be provided with a single pair of sheets, at least one of which is scored or otherwise weakened in appropriate places.

The above description describes use of resilient material disposed:

between the tiles or pellets; and between the bonded groups of tiles or pellets.

The resilient material may be metallic or an elastomer or may be a material that resiliently absorbs the shock of impact. The resilient material may be replaced either between the tiles or pellets or between the bonded groups of tiles or pellets or both with a frangible material that crushes under impact.

A construction that would emphasise the manner of operation of the present invention would be to provide stronger bonding within the bonded groups of tiles or pellets than between the bonded groups of tiles or pellets. This could be by way varying the nature of the bond within and between bonded groups of tiles or pellets. One way would be to vary the thickness of the bonding material. A further way might be to provide a resilient bond within the bonded groups of tiles or pellets and a frangible bond between the bonded groups of tiles or pellets.

The present invention is not limited to any particular level of threat, and can be applied to different levels of threat by varying tile or pellet dimensions, tile or pellet materials, backing construction, backing materials, sheet thicknesses, and sheet materials.

The invention claimed is:

1. Armour comprising an array of tiles or pellets assembled together in a spaced relationship with resilient material therebetween and confined between at least a pair of sheets that provide structural rigidity to the assembly, and in which at least one of said at least a pair of sheets extends continuously over boundaries between adjacent tiles or pellets but is weakened overlying the boundaries.

2. Armour as claimed in claim 1, in which at least one of the tiles or pellets is an individually confined tile or pellet.

3. Armour as claimed in claim 2, in which the at least one of the tiles or pellets is confined between a further pair of sheets.

4. Armour as claimed in claim 1, in which the tiles or pellets comprise bonded groups of tiles or pellets, said groups being assembled in an array and confined between the at least a pair of sheets.

5. Armour as claimed in claim 4, in which the at least one of said sheets that is weakened overlying boundaries between adjacent tiles or pellets, is weakened over boundaries between adjacent bonded groups of tiles or pellets.

6. Armour as claimed in claim 4, in which the bonded groups of tiles or pellets comprise an array of tiles or pellets confined between a further pair of sheets.

7. Armour as claimed in claim 4, in which at least one of the bonded groups of tiles or pellets comprises individually confined tiles or pellets.

8. Armour as claimed in claim 1, in which the tiles or pellets are ceramic tiles or pellets.

9. Armour as claimed in claim 4, in which stronger bonding is provided within the bonded groups of tiles or pellets than between the bonded groups of tiles or pellets.

10. Armour as claimed in claim 1, in which a backing layer is applied on a rear face of the armour.

11. Armour as claimed in claim 5, in which the bonded groups of tiles or pellets comprise an array of tiles or pellets confined between a further pair of sheets.

12. Armour as claimed in claim 5, in which at least one of the bonded groups of tiles or pellets comprises individually confined tiles or pellets.

13. Armour as claimed in claim 6, in which at least one of the bonded groups of tiles or pellets comprises individually confined tiles or pellets.

14. Armour as claimed in claim 5, in which stronger bonding is provided within the bonded groups of tiles or pellets than between the bonded groups of tiles or pellets.

15. Armour as claimed in claim 6, in which stronger bonding is provided within the bonded groups of tiles or pellets than between the bonded groups of tiles or pellets.

16. Armour as claimed in claim 7, in which stronger bonding is provided within the bonded groups of tiles or pellets than between the bonded groups of tiles or pellets.

17. Armour as claimed in claim 4, in which the tiles or pellets are ceramic tiles or pellets and in which stronger bonding is provided within the bonded groups of tiles or pellets than between the bonded groups of tiles or pellets.

18. Armour as claimed in claim 1, in which another sheet of said at least a pair of sheets is continuous overlying boundaries between adjacent tiles or pellets.

19. Armour as claimed in claim 1 further comprising adhesive layers, in which the at least a pair of sheets confining the array of tiles or pellets is bonded to the tiles or pellets by the adhesive layers.

* * * * *